United States Patent [19]

Oellers

[11] Patent Number: 4,787,566

[45] Date of Patent: Nov. 29, 1988

[54] METHOD AND MEANS FOR GUIDING SPLICED YARN IN A TEXTILE WINDER

[75] Inventor: Dieter Oellers, Monchen-Gladbach, Fed. Rep. of Germany

[73] Assignee: W. Schlafhorst & Co., Fed. Rep. of Germany

[21] Appl. No.: 115,257

[22] Filed: Oct. 30, 1987

[30] Foreign Application Priority Data

Oct. 31, 1986 [DE] Fed. Rep. of Germany ..... 3637033

[51] Int. Cl.[4] ..... B65H 54/22

[52] U.S. Cl. ..... 242/35.6 R

[58] Field of Search ..... 242/35.6 R, 35.6 E, 242/35.5 R, 18 R, 37 A; 289/1.5, 2, 5, 13, 15, 18.1

[56] References Cited

U.S. PATENT DOCUMENTS

| | | | |
|---|---|---|---|
| 2,407,366 | 9/1946 | Cotchett et al. | 242/35.6 R |
| 2,954,178 | 9/1960 | Furst | 242/35.6 R |
| 3,294,326 | 12/1966 | Raasch | 242/35.6 R |
| 3,595,493 | 7/1971 | Tsukuma et al. | 242/35.6 R |
| 4,246,744 | 1/1981 | Matsui et al. | 242/35.6 R X |

FOREIGN PATENT DOCUMENTS

| | | |
|---|---|---|
| 3029431 | 3/1982 | Fed. Rep. of Germany . |
| 3345467 | 6/1984 | Fed. Rep. of Germany . |
| 3336202 | 4/1985 | Fed. Rep. of Germany . |

*Primary Examiner*—Stanley N. Gilreath

*Attorney, Agent, or Firm*—Shefte, Pinckney & Sawyer

[57] ABSTRACT

A yarn engaging element is manipulated from a non-operating position through the winding path of a textile winder to engage and guide a yarn end to be spliced to a splicer. After splicing, the yarn engaging element returns at a controlled rate to release the spliced yarn at the winding path, with the release being sufficiently gradual to allow the resumption of winding to maintain tension in the spliced yarn as it moves from the splicer to the winding path, thereby avoiding sufficient slack in the spliced yarn to create kinking and yarn breaking. The yarn engaging element is manipulated by a four-link linkage controlled by a piston-cylinder mechanism or by a camming mechanism.

14 Claims, 2 Drawing Sheets

METHOD AND MEANS FOR GUIDING SPLICED YARN IN A TEXTILE WINDER

BACKGROUND OF THE INVENTION

The present invention relates to textile winders and more particularly to a method and means for guiding yarm to and from a splicer in a textile winder.

Textile winders are used to wind yarn from relatively small supply bobbins, that have been wound at spinning machines, onto large packages more suitable for use in subsequent processing of the yarn into textile products, and in doing so the winders are equipped to sense irregularities in the yarn and force yarn breaks to eliminate the irregularities, with the yarn ends then being spliced and winding reserved.

In performing the splicing, suction tubes pick up the yarn ends from the supply bobbin and winding package and pull them to a splicer that is out of the normal winding path of the yarn. In the splicer the ends are trimmed and spliced together by a blast of air or other means. Winding is then resumed with the spliced yarn released from the splicer and allowed to return to the normal winding path under winding tension. When the yarn ends are pulled to the splicer by the suction tubes and are positioned for splicing by the elements of the splicer, the path of the spliced yarn from the supply bobbin through the splicer to the winding package is considerably longer than the normal winding path, with the result that there is initial slack in the spliced yarn when it is released from the splicer upon resumption of winding, which slack can result in imperfect winding, kinking of the yarn and breaking of the yarn to require re-splicing, particularly when winding high twist synthetic yarns.

Furthermore, because the yarn must be fed through several components in traveling from the supply bobbin to the winding package, it is difficult to manipulate the yarn ends into proper position in these components as well as into the splicer. This is particularly significant with the yarn end from the winding package as the splicer is normally located with such components as the yarn measuring and breaking unit, lubricating unit, yarn guide and winding drum between the splicer and the winding package.

By the present invention, reliable and positive control is provided for manipulating yarn ends to a splicer and for releasing spliced yarn to the winding path under tension without deleterious slack.

SUMMARY OF THE INVENTION

Briefly described, the method of the present invention is an improvement in the method of automatically splicing yarn ends on a textile winder wherein yarn ends are picked up from a supply bobbin and a winding package and positioned at a splicer for splicing out of the normal path of winding, with the spiced yarn then being released to assume the winding path under the tension of winding. The improvement of the present invention includes guiding the spliced yarn from the splicer to the winding path during start-up of winding subsequent to splicing, while controlling the guiding to maintain the spliced yarn under winding tension without substantial slack as it is guided from the splicer to the winding path, thereby minimizing kinking and yarn breaks. Preferably, the method includes positioning the yarn end picked up from the winding package in the vicinity of the winding path and then guiding it to the splicer for splicing prior to the guiding from the splicer to the winding path. In the preferred embodiment of the method, the guiding of the yarn to the splicer is performed quicker than the guiding of the spliced yarn from the splicer to the winding path so that the operation can be performed as quickly as possible while maintaining a controlled release.

The present invention includes means for guiding the spliced yarn from the splicer to the winding path during start-up of winding subsequent to spicing, and means for controlling the guiding means to maintain the spliced yarn under winding tension without substantial slack as it is guided from the splicer to the winding path. Preferably, means are also provided for picking up the yarn end from the winding package and positioning it in the vicinity of the winding path, with the guiding means guiding the yarn end from the vicinity of the winding path to the splicer. Preferably, the controlling means controls the guiding means to guide the yarn end quicker to the splicer than from the splicer to the winding path.

The yarn guiding means preferably includes a hook-like yarn engaging element opening toward the splicer for engaging and guiding the yarn, and means for manipulating the element for movement from the splicer to the winding path for release of the sliced yarn thereat. The manipulating means may also manipulate the hook-like element for movement from the winding path to the splicer to guide the yarn end thereto preparatory to splicing. Preferably, the manipulating means additionally moves the hook-like element to a non-operating position in a direction at least partially transverse to the direction of movement to and from the splicer so that the element is out of contact with the yarn during normal winding operation.

In the preferred embodiment, the guiding means is in the form of a four-link linkage mounted on a mounting member. This linkage includes a drive link pivoted intermediate its ends on the mounting member, a driven link pivoted at one end on the mounting member, gear means drivingly connecting one end of the drive link and one end of the driven link, a yarn guiding link having one end pivoted to the other end of the driven link and having its other end extending for engagement with yarn positioned in the winding path. A control link is pivoted at one end on the mounting member and has its other end pivotally connected to the yarn guiding link intermediate its end. The controlling means includes means for oscillating the drive link to manipulate the yarn engaging other end of the yarn engaging link from a non-operating position through the winding path to the splicer and return through the winding path to the non-operating position. The links are articulated to cause the yarn engaging end of the yarn guiding link to move away from the winding path to the non-operating position in a direction at least partially transverse to the direction of movement between the winding path and the splicer.

The controlling means may be in the form of a cam disk having a first camming surface controlling manipulation of the guiding means from the non-operating position through the winding path to the splicer and a second camming surface for controlling manipulation of the guiding means from the splicer to the non-operating position, with the second camming surface being more gradual than the first camming surface for slower release of the yarn to avoid slack during winding start-up.

Alternatively, the controlling means may include a piston-cylinder mechanism for controlling manipulation of the guiding means from the non-operating position through the winding path to the splicer upon movement of the piston in one direction and from the splicer through the winding path to the non-operating position upon movement of the piston in the opposite direction. Means are included for introducing fluid into and discharging fluid from the cylinder at different rates to reciprocate the piston quicker in the direction moving the yarn to the splicer than in the opposite directing moving the yarn from the splicer to the winding path. This difference in rate of fluid introduction and discharge may be accomplished by a flow choke for restricting the flow of fluid during movement of the piston in the direction for guiding the yarn from the splicer to the winding path.

With the method and means of the present invention a reliable and simple operation and construction are provided for enhanced splicing and overall winding operation.

Other and further features and advantages of the present invention will be apparent from the accompanying drawings and the following description.

DETAILED DESCRIPTION OF THE PREFERRED EMBODIMENTS

Figure 1:
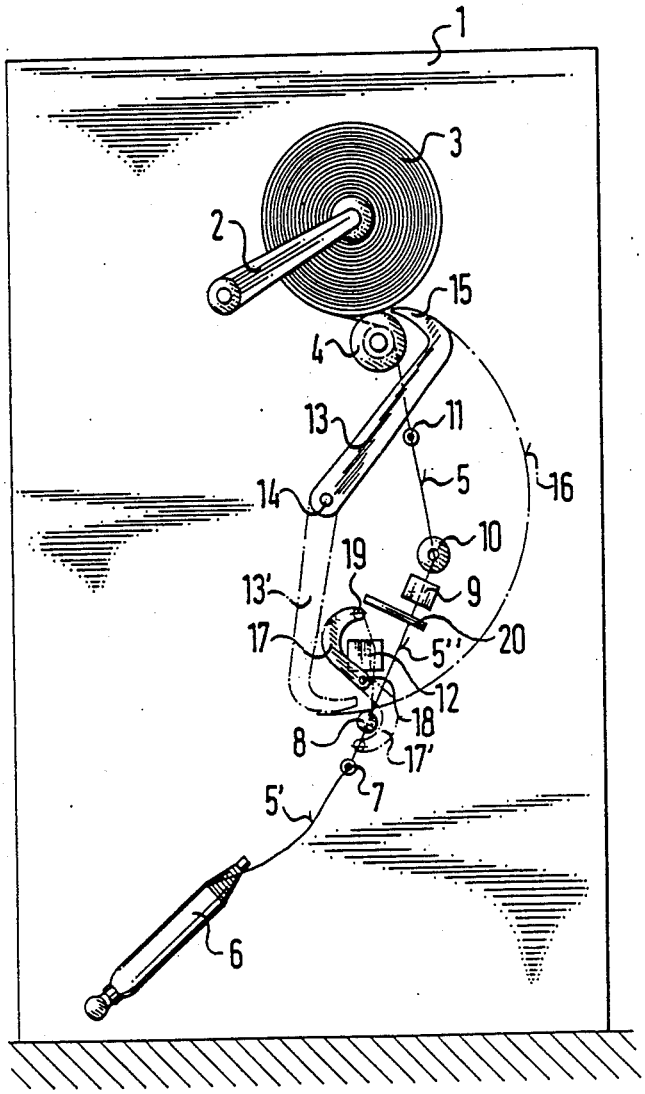
FIG. 1 is a schematic side elevation of a winding station of a textile winder in which the preferred embodiment of the means for guiding spliced yarn of the present invention is incorporated and with which the preferred embodiment of the method of the present invention is practiced.

Referring to FIG. 1, a side wall 1 of a textile winder is illustrated, having a creel 2 pivoted thereon for supporting a winding bobbin on which a yarn package 3 is wound. The yarn package 3 rests on a winding drum that drives the package and guides and traverses the yarn 5 as it is being wound on the package 3. The yarn 5 is drawn from a supply bobbin 6 successively through a yarn guide 7, a yarn brake 8, a yarn measuring and breaking unit 9, a lubricating unit 10 and a yarn guide 11 to the winding drum 4.

When a yarn break occurs, the supply yarn end 5′ is held in the yarn brake 8 and the winding yarn end 5 is wound onto the package 3. The yarn ends are then spliced together by a splicer 12 spaced from the normal winding path of the yarn 5. A conventional yarn splicing unit 12 includes devices for inserting the yarn into the splicer, guiding the yarn, preparing the yarn ends for splicing, forming of loops in the yarn to permit contraction into the splicer, and for performing the actual splicing, such as by blasts of air. Splicers of this type are well known in the art and need not be described herein as the details of the slicers do not constitute any part of the present invention.

Preliminary to splicing, the yarn ends must be picked up from the supply bobbin 6 and winding package 3 and drawn into position for insertion into the splicer 12. This is accomplished by means in the form of a suction tube 13 pivoted on a shaft 14 to the winder side wall 1 and manipulated in a known manner to position its suction opening at the yarn package 3 adjacent the winding drum 4, which is reversed to feed the wound yarn end to the suction opening 15. Rotation of the suction tube 13 downwardly, as illustrated in FIG. 1, to the position indicated in dash-dot lines and designated 13′ causes the yarn end from the winding package 3 to extend past the splicing unit 12 and be positioned for subsequent splicing. As the yarn is drawn downwardly in this manner, it is positioned on the winding drum 4, in the yarn guide 11, in the lubricating unit 10, and in the measuring and breaking unit 9.

In a similar fashion, a suction tube 17 is pivoted on a shaft 18 on the winder side wall 1 for positioning, as indicated in dot-dash lines in FIG. 1 and designated 17′, with its suction end 19 at the supply yarn end 5′ adjacent the yarn brake 8 so that it picks up the yarn end 5′. The suction arm 17 then pivots to the position indicated in solid lines in FIG. 1 to position the supply yarn end in the splicer 12.

With the manipulation of the suction tubes 13 and 17 as described, the supply yarn end 5′ extends from the supply bobbin 6 through the splicer 12 in position for splicing and the yarn end 5″ from the winding package 3 is positioned approximately in the normal winding path of the yarn at a spacing from the splicer 12.

The construction and operation of the winder described up to this point is conventional, and it is in this environment that the method and means of the present invention is incorporated in the form of means for guiding the yarn into the splicer and releasing the yarn from the splicer and means for controlling the guiding in the construction and method described below, with particular reference to FIGS. 2 and 3.

The guiding means includes a hook-like yarn engaging element 20 and a four-link linkage 27. This linkage 27 includes a yarn guiding link 23 having the yarn engaging element 20 at one end thereof and being pivoted on a connecting pin 28 to a driven link 24 and by connecting pin 29 to a control link 25. The driven link 24 is driven by a drive link 34 that is pivoted intermediate its ends on a shaft 35 secured to a mounting member in the form of a plate 26 supported on the winder side wall 1. The driven link 24 is also pivotally mounted on a shaft 31 to the mounting member 26. Gear means in the form of a toothed gear 32 fixed to the driven link 24 for rotation about the shaft 31 and a toothed gear segment 33 formed on one end of the drive link 34 in meshing engagement with the gear 32, transmits rotation of the drive link 34 to the driven link 24. The other end of the driven link 24 has mounted thereon the pivot pin 28 to which an end of the yarn guiding link 23 is attached, this end of the yarn guiding link 23 being the end other than the end at which the hook-like yarn engaging element 20 is formed. The control link 25 has one end pivoted on a shaft 30 on the mounting member 26 and its other end pivotally connected through a pivot pin 29 to the yarn guiding link 23 intermediate the ends of the yarn guiding link 23.

The above-described four-link linkage 27 forms means 36 for manipulating the hook-like yarn engaging element 20, which in the combination, form the yarn guiding means of the preferred embodiment of the preferred embodiment.

Figure 2:
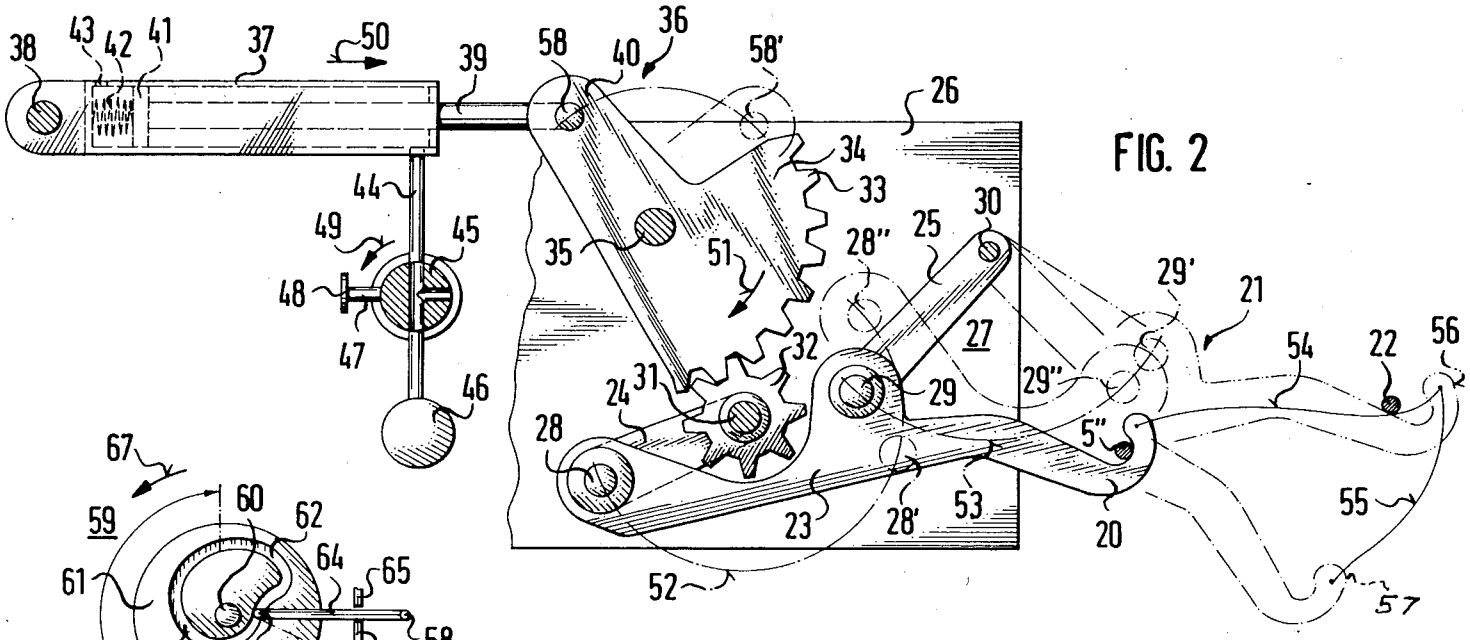
FIG. 2 is a plan view of the preferred embodiment of the yarn guiding means and controlling means of the preferred embodiment of the present invention.

Manipulation of the four-link linkage 27 is controlled in the embodiment illustrated in FIG. 2 by means in the form of a fluid piston-cylinder mechanism 37,41 pivoted on a pivot shaft 38 projecting from the mounting member 26. The piston-cylinder mechanism 37,41 includes a piston rod 39 articulated at its outer end by a connecting pin 58 to the other end 40 of the drive link 34, with the result that reciprocation of the piston rod 39 causes oscillation of the drive link 34 and, through the four-link linkage 27, manipulation of the yarn engaging element 20.

The rod 39 is connected to the piston 41 that is urged in a direction to extend the rod 39 by a compression spring 42 in the rear of the cylinder 37, which is vented through port 43. A compressed-air line 44 is connected to the front of the cylinder 37 from a source 46 of compressed air through a three way valve 45, which can be manipulated to vent the cylinder 37 through a venting tube 47 that includes a flow choke 48 for controlling the rate of discharge of air from the cylinder and, therefore, controlling the rate at which the yarn engaging element 20 is manipulated in moving yarn from the splicer to the winding path to release the yarn for winding subsequent to a splicing operation.

The operation of the three-way valve 45 may be controlled in a conventional manner by the main controls of the winder, such as a micro-processor, that controls all of the inter-related operations of the various components of the winder, including the operation of the splicer 12 and its associated elements.

With the construction as described heretofore, the components are in a normally non-operating position during continuous winding operation of the winder, in which the yarn 5 is in the normal winding path illustrated at 22 in FIG. 2. In this position, the three-way valve 45 is in a venting position with the spring 42 acting on the piston 41 to position the rod 39 in its extended position, and in which the connecting pin 58 on the end of the rod 39 is in the position indicated in dashdot lines and reference number 58' in FIG. 2. In this non-operating position the yarn guiding link 23 is in the dot-dash position determined by the connecting pin positions 28" and 29", with the yarn engaging element 20 disposed in its non-operating position 57 out of the winding path 22 of the yarn.

When a yarn break occurs and the suction tube 13 has picked up the yarn end from the winding package 3 and drawn it down into the winding path 22, the controls of the winder actuate the three-way valve 45 to connect the source of compressed air 46 with the interior of the cylinder 37, causing the piston 41 to retract the piston rod 39 and cause the connecting pin 58 to move from the extended position 58' to the solid line position 58 shown in FIG. 2. In moving through this stroke, the drive link 34 pivots in a direction opposite to the arrow 51, which, through the gear connection 32,33, causes clockwise rotation of the drive link 24, which, in turn, causes compound movement of the yarn-guiding link 23 under the control of control link 25, to cause the yarn engaging element 20 to move from the non-operating position 57 transversely through a position 56 slightly beyond the winding path 22 and then through the winding path to pick up the yarn and guide it to a position 5" at which it is positioned for engagement by the splicer 12. This position is shown in solid lines in FIG. 2.

The splicer 12 then performs an automatic splicing operation, following which the winder control manipulates the three-way valve 45 in the direction of the arrow 49 to connect the interior of the cylinder with the vent conduit 47 and flow choke 48. This allows the compression spring 42 to force the piston 41 and rod 49 to the extended position while the flow choke 48 controls the rate of movement. This extension of the rod 39 causes the drive link 34 to rotate in the direction of arrow 51, which rotates the driven link 24 counterclockwise and manipulates the yarn guiding link 23 from the position in which the yarn 5" is in splicing position outwardly to the winding path 22 and beyond to release the yarn, as indicated at 56, and then away from the winding path 22 in a direction transverse to the direction of movement from the splicer to the winding path to the nonoperating position 57 at which the yarn engaging element 20 is clear of the winding path 22 so as not to interfere with the yarn as it is being wound, and in which non-operating position the yarn engaging element 20 remains until the next splicing cycle is actuated.

As seen in FIG. 2, the yarn engaging element 20 moves in a slightly curved path 55 from the non-operating position 57, in which the yarn guide link 23 is located with the pivot pins in the positions indicated by reference numerals 28" and 29", to the position 56 slightly beyond the yarn path 22, at which the yarn guiding link 23 is located by the position of the pivot pin indicated by the reference numerals 28' and 29'. This is an intermediate position through which the yarn engaging element moves without stopping and continues to move along the somewhat S-shaped path 54 to engage the yarn end 55" and guide it to the splicer as the yarn guiding link 23 moves to the position indicated in solid lines in FIG. 2, which is the position of the elements indicated at 21 at the end of the stroke of the piston rod 39, at which position the elements are retained by the air pressure in the cylinder 37 until the winder controls again actuate the three-way valve 45 to vent the cylinder 37.

Because the three-way valve 45 connects the interior of the cylinder 37 directly to the source of compressed air 46, the action of drawing the yarn end 5" from the winding path to the splicer is quicker than the reverse movement controlled by the flow choke 48 for controlled movement of the spliced yarn from the splicer to the winding path under the tension of winding. This difference in flow allows controlled release of the spliced yarn while providing for quick drawing of the yarn end to the splicer for splicing so that maximum operating speeds can be maintained while providing a sufficiently slow release of the spliced yarn to avoid undesirable slack.

Figure 3:
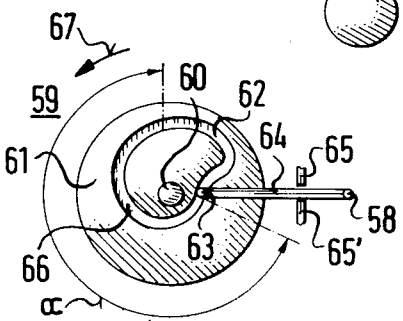
FIG. 3 is a plan view of an alternate form of the controlling means of the preferred embodiment of the present invention.

An alternate form of the controlling means is illustrated in FIG. 3, in which the connecting pin 58 for operating the drive link 34 is on the end of a rod 64 that is guided in stationary guides 65,65'. This alternate form of the controlling means is in the form of a cam mechanism 59 having a cam disk 61 fixed on a central shaft 60 that is rotated by the winder control to rotate the cam disk 61. The cam disk 61 has a cam groove 62 in which a follower finger 63 projecting from the rod 64 is positioned. The cam groove 62 is formed with a first camming surface for moving the rod 64 to control manipulation of the guiding means to move the yarn engaging element 20 from the non-operating position through the winding path to the splicer in the same manner as described above, and a second camming surface 66 for moving the rod 64 to control manipulation of the guiding means to move the yarn engaging element 20 from the splicer to the non-operating position. As seen in FIG. 3, the second camming surface 66 extends over an arch $\alpha$ and is considerably more gradual than the first camming surface, which extends between the ends of the angle α so that the manipulation of the yarn engaging element 20 is more gradual in releasing the spliced yarn to avoid development of slack, and the movement to draw the yarn into splicing position is quicker for more rapid overall operation.

Thus, when cam disk 61 is rotated, which is in the direction of the arrow 67, the rod 64 moves generally gradually, with controlled release of the spliced yarn ynder tension of resumed winding, from the splicing position of components illustrated in FIG. 3 through the yarn releasing position to the non-operating position, at which time the cam disk 61 stops until another splicing cycle is to be performed, at which time the cam disk resumes rotation in the same direction, causing the rod 64 to move along the steeper cam section, thereby manipulating the yarn engaging element 20 to quickly move from the non-operating position through the winding path to pick up the yarn end and rapidly position it at the splicer.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a method of automatically splicing yarn ends on a textile winder wherein yarn ends are picked up from a supply bobbin and a winding package and positioned at a splicer for splicing out of the normal path of winding with the spliced yarn then being released to assume the winding path under the tension of winding, the improvement comprising: guiding said spliced yarn from said splicer to said winding path during start-up of winding subsequent to splicing while controlling said guiding to maintain the spliced yarn under winding tension without substantial slack as it is guided from said splicer to said winding path, thereby minimizing kinking and yarn breaks.

2. In a method of automatically splicing yarn, the improvement according to claim 1 and characterized further by positioning the yarn end picked up from the winding package in the vicinity of the winding path and then guiding it to the splicer for splicing prior to said guiding from the splicer to the winding path.

3. In a method of automatically splicing yarn the improvement according to claim 2 and characterized further in that said guiding of the yarn to the splicer is performed quicker than said guiding of the spliced yarn from the splicer to the winding path.

4. In a textile winder of the type having means for automatically splicing yarn ends and means for picking up yarn ends from a supply bobbin and a winding package and positioning said yarn ends at said splicing means out of the winding path, the improvement comprising: means for guiding said spliced yarn from said splicing means to said winding path during start-up of winding subsequent to splicing and means for controlling said guiding means to maintain the spliced yarn under winding tension without substantial slack as it is guided from said splicing means to said winding path, thereby minimizing kinking and yarn breaks.

5. In a textile winder, the improvement according to claim 4 and characterized further in that said means for picking up yarn ends includes means for picking up the yarn end from the winding package and positioning it in the vicinity of the winding path, and said guiding means guides the yarn end from the vicinity of the winding path to said splicing means for splicing.

6. In a textile winder, the improvement according to claim 5 and characterized further in that said controlling means controls said guiding means to guide said yarn end to said splicing means quicker than from said splicing means to the winding path.

7. In a textile winder, the improvement according to claim 4 and characterized further in that said yarn guiding means includes a hook-like yarn engaging element opening toward said splicing means for engaging and guiding said yarn, and means for manipulating said element for movement from said splicing means to said winding path for release of the spliced yarn thereat.

8. In a textile winder, the improvement according to claim 5 and characterized further in that said yarn guiding means includes a hook-like yarn engaging element opening toward said splicing means for engaging and guiding said yarn, and means for manipulating said element for movement from the winding path to said splicing means, to guide the yarn end thereto, and return to the winding path after splicing for release of the spliced yarn thereat.

9. In a textile winder, the improvement according to claim 7 and characterized further in that said means for manipulating moves said hook-like element to a non-operating position in a direction at least partially transverse to the direction of movement from said splicing means to said winding path.

10. In a textile winder, the improvement according to claim 8 and characterized further in that said manipulating means moves said hook-like element to a non-operating position in a direction at least partially transverse to the direction of movement from said splicing means to said winding path.

11. In a textile winder, the improvement according to claim 5, 6, 8 or 10 and characterized further in that said guiding means includes a four-link linkage comprising: a mounting member, a drive link pivoted intermediate its ends on said mounting member, a driven link pivoted at one end on said mounting member, gear means drivingly connecting one end of said drive link and said one end of said driven link, a yarn guiding link having one end pivoted to the other end of said driven link and having its other end extending for engagement with yarn positioned in said winding path, a control link having one end pivoted on said mounting memter and its other end pivotally connected to said yarn guiding link intermediate its ends, said controlling means comprises means for oscillating said drive link to manipulate said yarn engaging other end of said yarn engaging link from a non-operating position through said winding path to said splicing means and return through said winding path to said non-operating position, said links being articulated to cause said yarn engaging end of said yarn guiding link to move away from said winding path to said non-operating position in a direction at least partially transverse to the direction of movement between the winding path and said splicing means.

12. In a textile winder, the improvement according to claim 11 and characterized further in that said controlling means includes a cam disk having a first camming surface controlling manipulation of said guiding means from said non-operating position through said winding path to said splicing means and a second camming surface for controlling manipulation of said guiding means from said splicing means to said non-operating position, said second camming surface being more gradual than said first camming surface.

13. In a textile winder, the improvement according to claim 11 and characterized further in that said controlling means includes a piston-cylinder mechanism for controlling manipulation of said guiding means from said non-operating position through said winding path to said splicing means upon movement of the piston in one direction and from said splicing means through the winding path to said non-operating position upon movement of the piston in the opposite direction, and means for introducing fluid into and discharging fluid from the piston of said cylinder mechanism at different rates to reciprocate the piston thereof quicker in said one direction than in said opposite direction.

14. In a textile winder, the improvement according to claim 13 and characterized further in that said fluid introducing and discharging means includes a flow choke for restricting the flow of fluid during movement of the piston in said opposite direction.

* * * * *